US008033921B2

(12) United States Patent
Habing

(10) Patent No.: US 8,033,921 B2
(45) Date of Patent: Oct. 11, 2011

(54) BUNGEE TEETER-TOTTER

(75) Inventor: Theodore G. Habing, Tustin, CA (US)

(73) Assignee: Dream Visions, LLC, Tustin, CA (US)

( * ) Notice: Subject to any disclaimer, the term of this patent is extended or adjusted under 35 U.S.C. 154(b) by 47 days.

(21) Appl. No.: 12/534,307

(22) Filed: Aug. 3, 2009

(65) Prior Publication Data

US 2009/0291768 A1 Nov. 26, 2009

Related U.S. Application Data

(63) Continuation-in-part of application No. 11/473,636, filed on Jun. 23, 2006, now Pat. No. 7,572,190.

(51) Int. Cl.
*A63G 11/00* (2006.01)
*A63G 13/00* (2006.01)

(52) U.S. Cl. ..... 472/110; 472/113; 472/135

(58) Field of Classification Search ..... 472/95, 472/103–106, 110, 113, 135, 136; 482/27, 482/30, 31, 51, 77
See application file for complete search history.

(56) References Cited

U.S. PATENT DOCUMENTS

| | | | |
|---|---|---|---|
| 43,972 | A | 8/1864 | Coldwell |
| 76,053 | A | 3/1868 | Coldwell |
| 82,992 | A | 10/1868 | Rich |
| 217,918 | A | 7/1879 | White |
| 232,217 | A | 9/1880 | Tuttle |
| 458,136 | A | 8/1891 | Wilder |
| 819,878 | A | 5/1906 | Grindy |
| 847,787 | A | 3/1907 | Kyle |
| 935,854 | A | 10/1909 | Linerode |
| 1,060,590 | A | 5/1913 | Donnenwerth |
| D55,572 | S | 6/1920 | Peterson |
| 1,408,670 | A | 3/1922 | Williams |
| 1,432,746 | A | 10/1922 | Downey |
| 1,435,585 | A | 11/1922 | Coleman |
| 1,461,631 | A | 7/1923 | Smerechanski |
| 1,488,808 | A | 4/1924 | Dove |
| 1,527,015 | A | 2/1925 | Sedlacek |
| 1,533,261 | A | 4/1925 | Pattison et al. |
| 1,550,040 | A | 8/1925 | Nagy |
| 1,553,520 | A | 9/1925 | Dougherty |
| 1,577,037 | A | 3/1926 | Kocher |
| 1,578,852 | A | 3/1926 | Schmutzer |
| 1,580,508 | A | 4/1926 | Liles |
| 1,586,254 | A | 5/1926 | Lovejoy |
| 1,598,512 | A | 8/1926 | Taylor |
| 1,600,362 | A | 9/1926 | Reid |
| 1,635,931 | A | 7/1927 | Free |
| 1,640,150 | A | 8/1927 | Henry et al. |
| 1,677,531 | A | 7/1928 | Shanton |
| 1,850,927 | A | 3/1932 | Frederick |
| 1,898,466 | A | 2/1933 | Pierson |
| 1,961,796 | A | 6/1934 | Shuster |

(Continued)

*Primary Examiner* — Kien Nguyen
(74) *Attorney, Agent, or Firm* — Blakely Sokoloff Taylor & Zafman LLP

(57) ABSTRACT

A single rider teeter-totter has a support frame and a longitudinal beam member pivotally coupled to the support frame. A seat for a user is attached to a first end of the beam member. A counterbalancing resistance is provided by a plurality of elastic members, each of which is attached at a first end to the support frame. A number of the elastic members appropriate to the weight of the user are secured to a securing station disposed on the beam member. The unused elastic members may be secured to a second securing station attached to the support frame.

26 Claims, 4 Drawing Sheets

U.S. PATENT DOCUMENTS

| | | | |
|---|---|---|---|
| RE19,327 | E | 9/1934 | Shuster |
| 1,992,127 | A | 2/1935 | Marlowe |
| 2,050,500 | A | 8/1936 | Osborn |
| 2,107,448 | A | 2/1938 | Marlowe |
| 2,130,438 | A | 9/1938 | Westerlund |
| 2,198,947 | A | 4/1940 | Olson |
| 2,201,036 | A | 5/1940 | Guerrier |
| 2,252,008 | A | 8/1941 | Joncas |
| 2,325,988 | A | 8/1943 | Thomas |
| 2,398,122 | A | 4/1946 | Souza |
| 2,457,627 | A | 12/1948 | Bailey |
| 2,509,796 | A | 5/1950 | Bailey |
| 2,527,763 | A | 10/1950 | Probst |
| 2,542,359 | A | 2/1951 | Rocklin |
| 2,544,106 | A | 3/1951 | Ray |
| 2,704,111 | A | 3/1955 | Wunderlich |
| 2,735,679 | A | 2/1956 | Mortenson |
| 3,046,011 | A | 7/1962 | Songer |
| 3,117,780 | A | 1/1964 | Gregory |
| 3,140,869 | A | 7/1964 | Pacuk |
| 3,298,685 | A | 1/1967 | Williams |
| 3,420,522 | A | 1/1969 | Elliott |
| 3,472,507 | A | 10/1969 | Michel |
| 3,514,103 | A | 5/1970 | Lieberman |
| 3,638,941 | A | 2/1972 | Kulkens |
| 3,721,437 | A | 3/1973 | Skaricic |
| 3,860,226 | A | 1/1975 | Hensiek, Jr. |
| 3,968,962 | A | 7/1976 | Atkins et al. |
| 4,226,411 | A | 10/1980 | Manus |
| 4,351,522 | A | 9/1982 | Marburger et al. |
| 4,582,319 | A | 4/1986 | Luna |
| 4,591,150 | A | 5/1986 | Mosher |
| 4,632,390 | A | 12/1986 | Richey |
| 4,693,468 | A | 9/1987 | Kurlytis et al. |
| 5,002,271 | A | 3/1991 | Gonzales |
| 5,435,798 | A | 7/1995 | Habing et al. |
| 5,527,248 | A | 6/1996 | Crivello |
| 5,547,425 | A | 8/1996 | Krhs et al. |
| 5,547,443 | A | 8/1996 | Chen |
| 5,569,124 | A | 10/1996 | Raynie et al. |
| 5,605,524 | A | 2/1997 | Husted |
| 5,616,109 | A | 4/1997 | Szu-Ming |
| 5,624,353 | A | 4/1997 | Naidus |
| 5,951,406 | A | 9/1999 | Steane |
| 6,202,263 | B1 | 3/2001 | Harker |
| 6,872,145 | B1 | 3/2005 | Boudreaux et al. |
| 7,278,958 | B2 | 10/2007 | Morgan |
| 7,452,311 | B2 | 11/2008 | Barnes et al. |
| 7,572,190 | B2 * | 8/2009 | Habing ..... 472/110 |
| 2006/0128482 | A1 | 6/2006 | Habing |
| 2007/0037679 | A1 | 2/2007 | Geeting |
| 2007/0232468 | A1 | 10/2007 | Levy et al. |

* cited by examiner

BUNGEE TEETER-TOTTER

RELATED APPLICATION

This application is a continuation-in-part of co-pending application Ser. No. 11/473,636 filed Jun. 23, 2006, the disclosure of which is incorporated herein by reference.

BACKGROUND OF THE INVENTION

1. Field of the Invention

This invention relates to the field of amusement devices, particularly teeter-totters. Specifically, the invention relates to a single rider teeter-totter balanced with elastic members.

2. Background

Teeter-totters, also known as seesaws, have long been popular items of playground equipment for children. Teeter-totters come in various configurations, but most are fundamentally similar. In the most basic configuration, a teeter-totter can be simply a plank supported near its center for pivotal movement.

A variation of the conventional two-rider teeter-totter is one adapted for use by a single rider. One-sided, single-rider teeter-totters typically consist of a pivoting seat with a counterbalance, such as a spring, to balance the rider's weight. The rider rides up and down on the seat in a bouncing manner against the elastic resistance of the spring or other counterbalance device. Early versions of such teeter-totters are shown, for example, in U.S. Pat. No. 935,854 issued to Linerode and U.S. Pat. No. 1,533,261 issued to Pattison. An improved spring balanced single rider teeter-totter is shown in Applicant's earlier U.S. patent application Ser. No. 11/473,636, the disclosure of which is incorporated herein by reference.

Applicant's earlier spring-balanced teeter-totter provides a highly enjoyable riding experience; however, the spring mechanism is somewhat costly. A similar teeter-totter may be more economically produced using elastic cords or bands to provide the counterbalancing resistance.

SUMMARY OF THE INVENTION

The present invention provides a single rider teeter-totter having a support frame and a longitudinal beam member pivotally coupled to the support frame. A seat for a user is attached to a first end of the beam member. A counterbalancing resistance is provided by a plurality of elastic members, each of which is attached at a first end to the support frame. A number of the elastic members appropriate to the weight of the user are secured to a securing station disposed on the beam member. The unused elastic members may be secured to a second securing station attached to the support frame.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
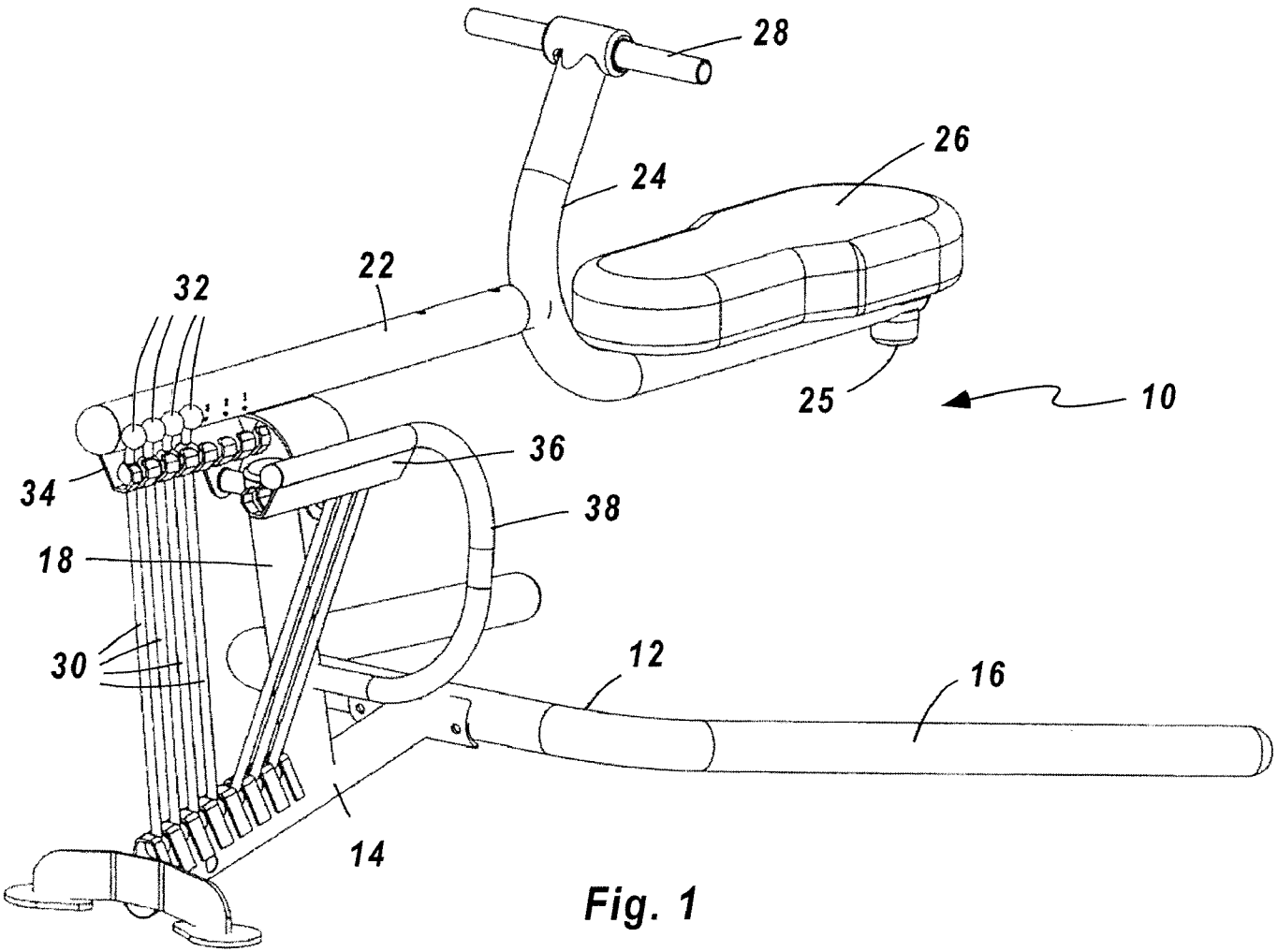
FIG. 1 is a perspective view of a single rider teeter-totter in accordance with an embodiment of the present invention.
Figure 2:
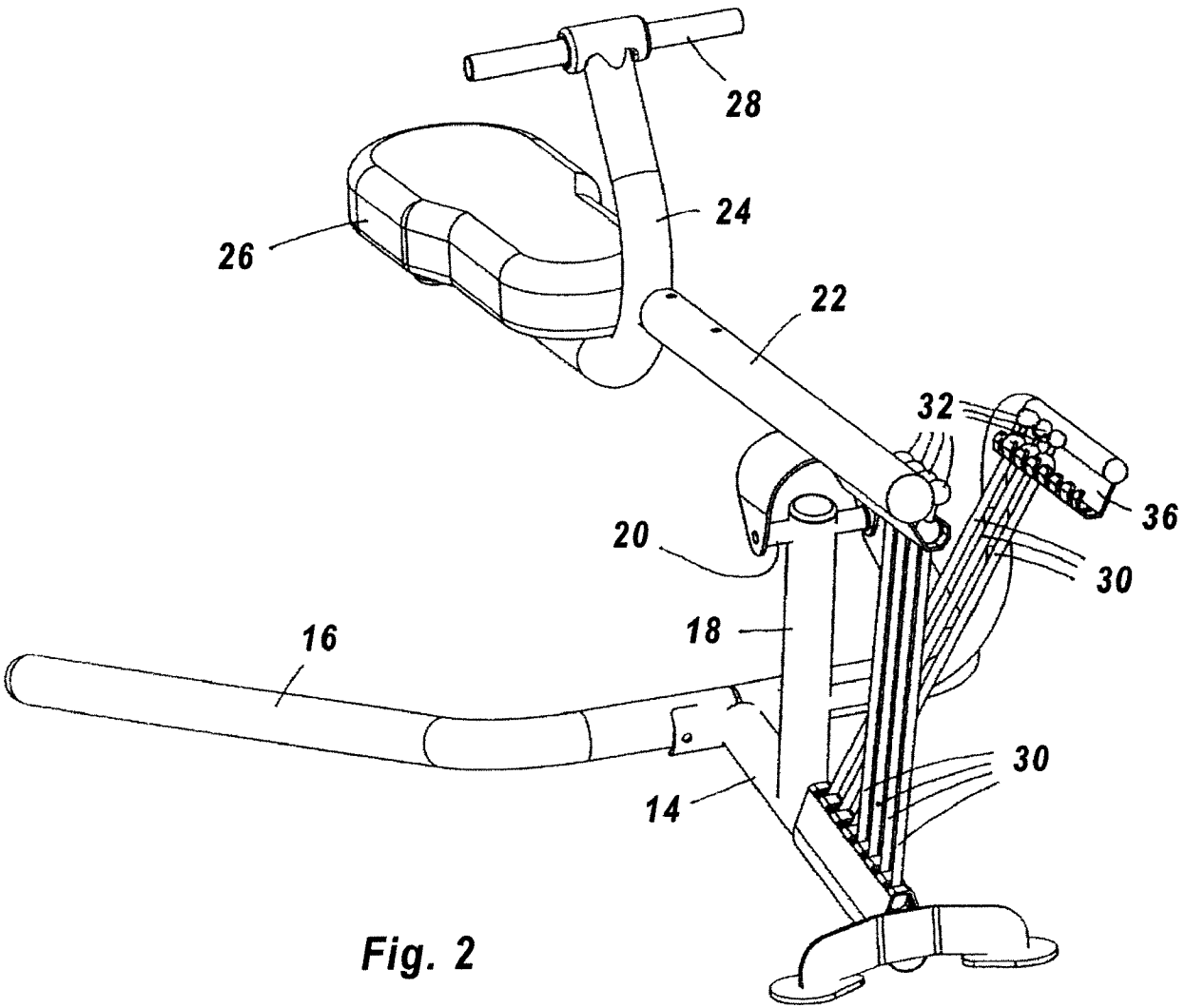
FIG. 2 is another perspective view of the teeter-totter shown in FIG. 1.

FIGS. 1 and 2 are perspective views of a single rider teeter-totter 10 in accordance with an embodiment of the present invention. A frame 12 comprises forward support member 14 and generally U-shaped rear support member 16. The frame further comprises pivot support post 18 with pivot assembly 20 attached at the top thereof. Longitudinal beam 22 is coupled to pivot assembly 20. Seat support member 24 is attached to beam 22. The various components of frame 12 may be fabricated from tubular steel as is common for exercise and playground equipment, although other materials may be used if desired.

Seat 26 is attached to seat support member 24. Seat 26 may be constructed of a molded foam, wood or plastic material. A handle bar 28 is attached to the upper portion of seat support member 24. The weight of a rider in the seat 26 is counterbalanced by elastic members 30. These elastic members may be made of natural or synthetic rubber or, more preferably, may be similar in construction to conventional "bungee cords". The lower ends of elastic members 30 are secured to forward support member 14.

The upper ends of elastic members 30 are fitted with knobs 32. A securing station 34 is disposed at the forward end of beam 22. The securing station has an array of fingers separated by slots for retaining knobs 32. The fingers are spaced so that elastic members 30 fit within the slots, but knobs 32 are retained by the fingers. The securing station may also be cut into the tube wall of forward support tube 14 thus eliminating the need for additional material or fastening. A second securing station 36 is attached to arm 38, which is attached to pivot support post 18. A selected number of elastic members 30 are secured to securing station 34 to provide a counterbalancing force appropriate to the weight of the user. The unused elastic members 30 are secured to securing station 36 to keep them neatly stored while not in use. Alternatively, unused elastic members 30 may simply be allowed to rest on the ground or supporting surface, in which case securing station 36 may be omitted. As shown, the upper ends of elastic members 30 are fitted with a pair of slightly spaced apart knobs 32. The lower knob is retained by the securing station, while the upper knob can be more easily grasped to engage or disengage the elastic member from the securing station.

It will be appreciated that the elastic members may instead be attached to the forward end of beam 22 and that the securing station 34 may be disposed on forward support member 14. In this case, the unused elastic members may simply be allowed to hang from beam 22. This arrangement, while equally effective in counterbalancing the rider, is less convenient since it would be more difficult to insert and remove the elastic members from a lower securing station.

Although securing stations 34 and 36 are shown with a fixed array of fingers, at least station 34 may be configured with hinged fingers that may be folded over knobs 32 to more securely retain the elastic members being used to provide counterbalancing resistance. Securing station 34 may be constructed as a separate element or may be integrally formed with beam member 22. Securing station 34 may be attached to beam member 22 so that it is vertically adjustable, thereby providing an adjustment for the rest height of seat 26.

In the event of failure of an elastic member, or if the resistance is not properly selected, or if the rider is simply overly exuberant, impact with the ground is cushioned by bumper 25 attached to seat support member 24. Furthermore, the design of generally U-shaped rear support member 16 ensures that the rider will not contact any of the frame members at the bottom limit of travel and also eliminates pinch points in the vicinity of the seat.

Figure 3:
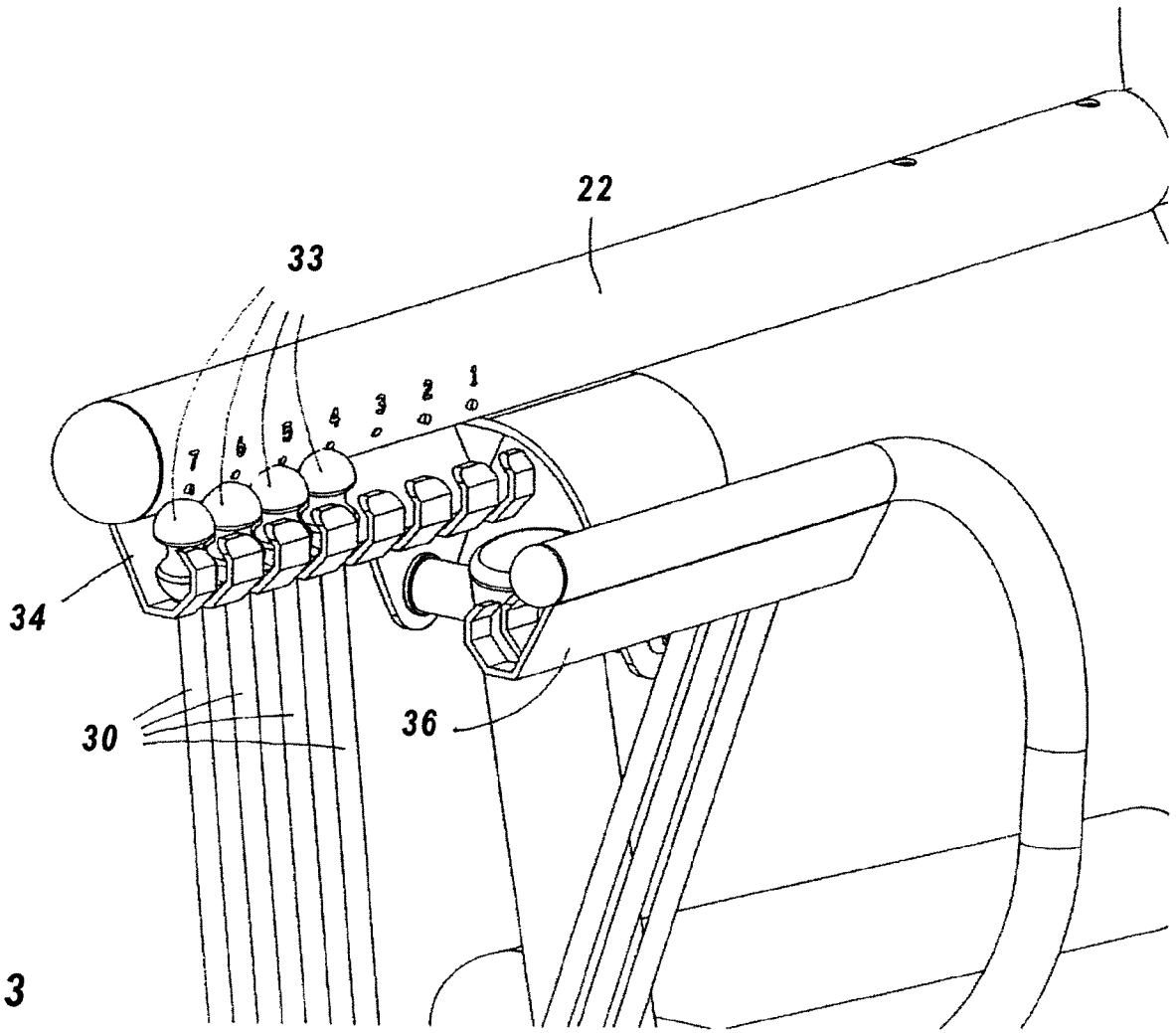
FIG. 3 is a detailed view showing a modification to the embodiment of FIGS. 1 and 2.

FIG. 3 illustrates a modification of the embodiment previously described. Here, the upper ends of elastic members 30 have knobs 33 that are generally in the shape of an hourglass. The narrowed center portion of knobs 33 make the knobs easier to grip when securing the connected elastic member to either of securing stations 34 or 36.

Figure 4:
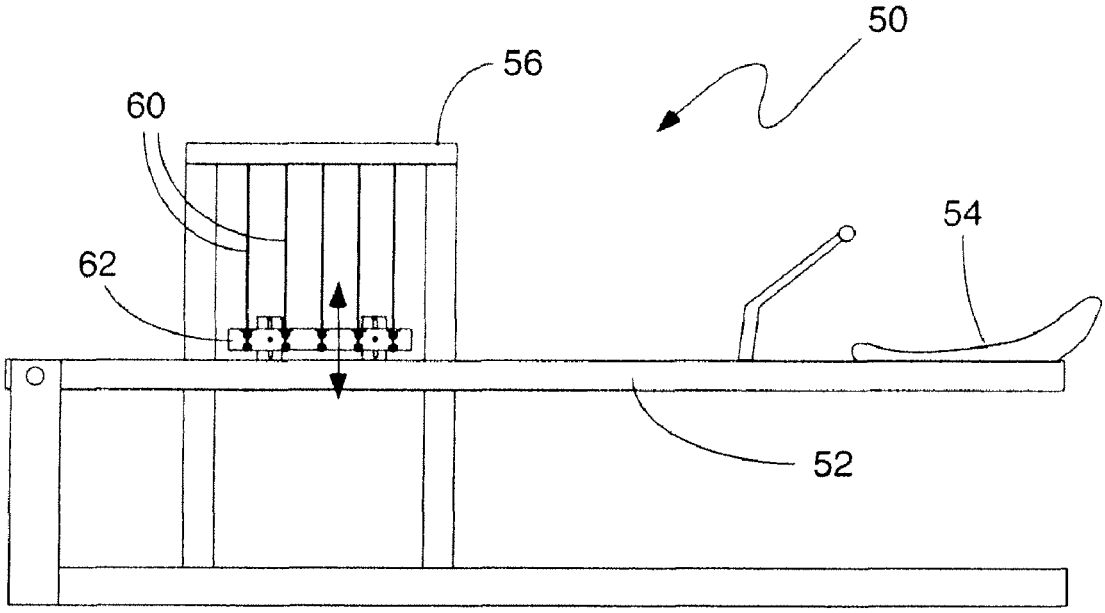
FIG. 4 is a diagrammatic illustration of a single rider teeter-totter in accordance with another embodiment of the present invention.

FIG. 4 is a diagrammatic illustration of a single rider teeter-totter 50 in accordance with another embodiment of the present invention. In this embodiment, the beam member 52 is pivotally supported at one end and seat 54 is disposed at the opposite end of the beam. Support frame 56 extends above the beam member 52 where elastic members 60 are attached. Elastic members 60 hang down from the support frame towards the beam member where they are secured at securing station 62. As in the previously described embodiment, securing station 62 may be secured to beam 52 such that it is vertically adjustable, thereby providing a convenient means for adjusting the rest height of the seat.

Figure 5:
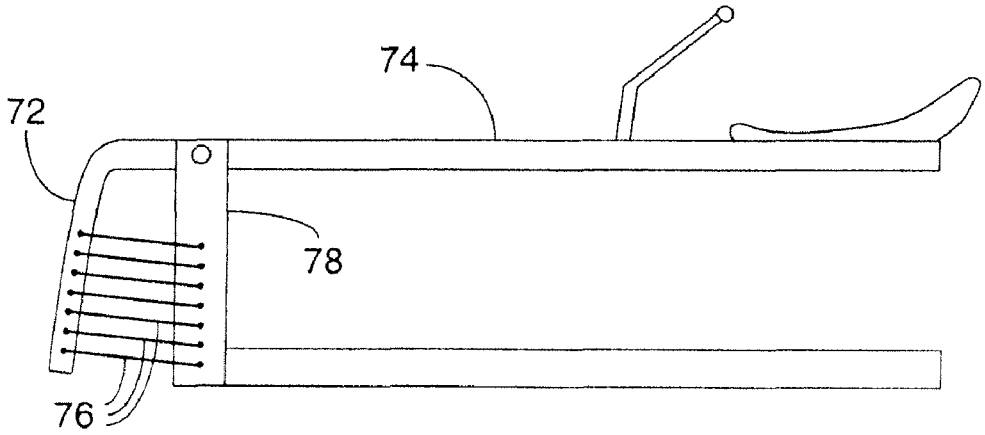
FIG. 5 illustrates still another embodiment of the present invention.

FIG. 5 illustrates still another embodiment of the present invention in which the end 72 of the beam member 74 is curved downward on the opposite side of the pivot from the seat. Elastic members 76 are attached between the pivot support post 78 and the end 72 of the beam member.

In each of the above-described embodiments, a selected number of the elastic members are secured between the beam member and the supporting frame to counterbalance the weight of a user for bouncing action.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A play apparatus comprising:

a support frame;

a beam member having a first end and a second end, the beam member pivotally coupled to the support frame between the first and second ends;

a seat attached to the first end of the beam member;

a plurality of elastic members, each attached to the support frame;

a first securing station disposed on the beam member proximate to the second end thereof, the first securing station configured to secure a second end of the elastic members to the beam member for counterbalancing a rider in the seat;

wherein the second end of the elastic members is fitted with a pair of spaced apart knobs.

2. The play apparatus of claim 1 further comprising a second securing station attached to the support frame, the second securing station configured to secure the second end of the elastic members to the support frame when not in use.

3. The play apparatus of claim 1 wherein the first securing station is configured with a plurality of fingers separated by slots dimensioned to admit the elastic members but retain the knobs.

4. The play apparatus of claim 1 wherein the first securing station has a first configuration for receiving the elastic members and a second configuration for securely retaining the elastic members.

5. The play apparatus of claim 1 wherein the first securing station is adjustably positionable on the beam member.

6. The play apparatus of claim 1 wherein the support frame comprises a forward support member, a generally U-shaped rear support member and a pivot support post.

7. The play apparatus of claim 6 wherein the first end of the elastic members is attached to the forward support member.

8. A play apparatus comprising:

a support frame;

a beam member having a first end and a second end, the beam member pivotally coupled to the support frame between the first and second ends;

a seat attached to the first end of the beam member;

a plurality of elastic members, each attached to the support frame;

a first securing station disposed on the beam member proximate to the second end thereof, the first securing station configured to secure a second end of the elastic members to the beam member for counterbalancing a rider in the seat;

wherein the second end of the elastic members is fitted with a knob having a grip portion.

9. The play apparatus of claim 8 wherein the first securing station is adjustably positionable on the beam member.

10. The play apparatus of claim 8 wherein the support frame comprises a forward support member, a generally U-shaped rear support member and a pivot support post.

11. The play apparatus of claim 10 wherein the first end of the elastic members is attached to the forward support member.

12. The play apparatus of claim 5 wherein the first securing station has a first configuration for receiving the elastic members and a second configuration for securely retaining the elastic members.

13. The play apparatus of claim 8 wherein the first securing station is configured with a plurality of fingers separated by slots dimensioned to admit the elastic members but retain the knob.

14. The play apparatus of claim 8 wherein the knob has a generally hourglass shape.

15. A play apparatus comprising:

a support frame;

a beam member pivotally coupled to the support frame;

a seat attached to the beam member;

a plurality of elastic members, each attached at a first end to the support frame;

a first securing station disposed on the beam member, the first securing station configured to secure a second end of the elastic members to the beam member for counterbalancing a rider in the seat;

wherein the second end of the elastic members is fitted with a pair of spaced apart knobs.

16. The play apparatus of claim 15 further comprising a second securing station attached to the support frame, the second securing station configured to secure the second end of the elastic members to the support frame when not in use.

17. The play apparatus of claim 15 wherein the first securing station is configured with a plurality of fingers separated by slots dimensioned to admit the elastic members but retain the knobs.

18. The play apparatus of claim 15 wherein the first securing station has a first configuration for receiving the elastic members and a second configuration for securely retaining the elastic members.

19. The play apparatus of claim 15 wherein the first securing station is adjustably positionable on the beam member.

20. The play apparatus of claim 15 wherein the support frame comprises a forward pivot support post and a generally U-shaped support member.

21. A play apparatus comprising:

a support frame;

a beam member pivotally coupled to the support frame;

a seat attached to the beam member;

a plurality of elastic members, each attached at a first end to the support frame;

a first securing station disposed on the beam member, the first securing station configured to secure a second end of the elastic members to the beam member for counterbalancing a rider in the seat;

wherein the second end of the elastic members is fitted with a knob having a grip portion.

22. The play apparatus of claim 21 wherein the first securing station is configured with a plurality of fingers separated by slots dimensioned to admit the elastic members but retain the knob.

23. The play apparatus of claim 21 wherein the knob has a generally hourglass shape.

24. The play apparatus of claim 21 wherein the first securing station has a first configuration for receiving the elastic members and a second configuration for securely retaining the elastic members.

25. The play apparatus of claim 21 wherein the first securing station is adjustably positionable on the beam member.

26. The play apparatus of claim 21 wherein the support frame comprises a forward pivot support post and a generally U-shaped support member.

* * * * *